United States Patent [19]

Rau

[11] 4,348,778

[45] Sep. 14, 1982

[54] EMERGENCY TOILET WATER PROTECTION UNIT

[76] Inventor: Joseph P. Rau, 15351 Woodruff Pl., Bellflower, Calif. 90607

[21] Appl. No.: 84,603

[22] Filed: Oct. 15, 1979

[51] Int. Cl.[3] ..... A47K 17/00

[52] U.S. Cl. ..... 4/661; 4/427; 4/366

[58] Field of Search ..... 4/427, 661, 366, 367

[56] References Cited

U.S. PATENT DOCUMENTS 4,170,049 10/1979 Gilliland ..... 4/427

4,204,285 5/1980 Pak ..... 4/427

*Primary Examiner*—Henry K. Artis

*Attorney, Agent, or Firm*—Smyth, Pavitt, Siegemund & Martella

[57] ABSTRACT

An apparatus combining a flush toilet including a toilet bowl and water supply tank and a device for preventing the flow of water into and out of the supply tank. The supply tank includes a ball float and an outlet water control plunger which is located adjacent to a vertically extending pipe mounted at the base of the tank. A tubular sleeve is installed over the pipe and includes thereon an outer sleeve and a control arm that is pivotedly attached to the tubular sleeve and positioned below and generally opposite to the ball float. A plunger is mounted onto and extending out from the tubular sleeve and is positioned above and generally opposite to the water control plunger. A triggering device is provided to activate the control arm and the plunger to contact the ball float and water control plunger to stop the flow of water into and out of the supply tank.

6 Claims, 13 Drawing Figures

FIG. 9
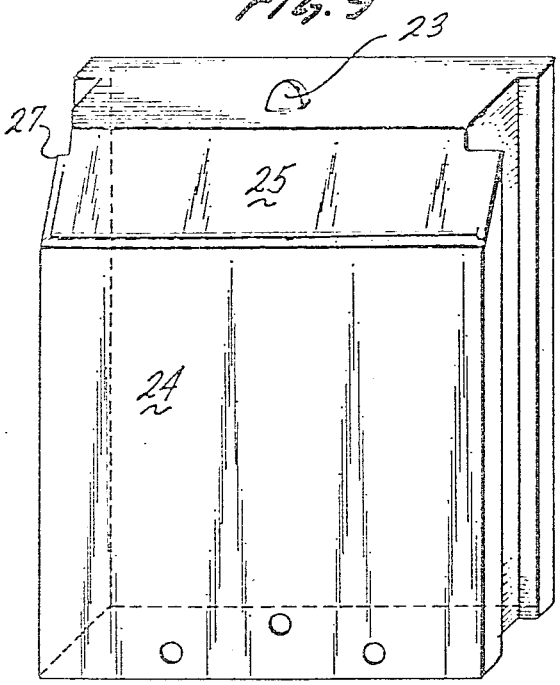
FIG. 10
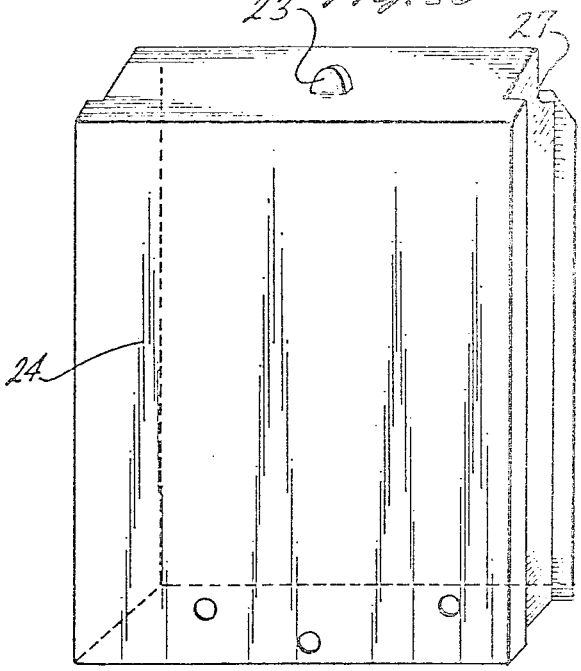
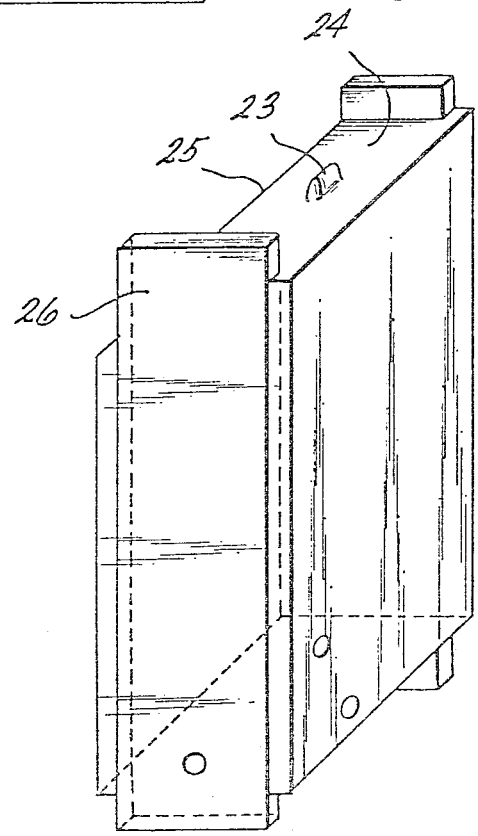
FIG. 11

EMERGENCY TOILET WATER PROTECTION UNIT

This invention relates to a new and useful improvement concerning toilet water overflow problems, particularly an improvement that will provide immediate protection from accidental water overflow in toilet bowls due to obstructions and related causes. This device will protect carpetings, walls, flooring and ceilings , (in two or more story buildings).

Protection from toilet water overflow is seriously needed in homes, schools, commerical and public buildings.

Therefore, it is the principal object of the present invention to provide a toilet shut-off control which will manually or automatically shut off the flow of fresh water into the water supply tank and from the supply tank into the toilet bowl when, as a result of an obstruction in the toilet bowl, the water in the bowl has risen to an excessively high level. The manual unit installs in a matter of seconds, is lightweight, easy to operate, comes pre-assembled and may be manufactured at low cost. The automatic trigger unit is manufactured within the toilet bowl walls by a manufacture. These together with other objects and advantages which will become subsequently apparent reside in the details described and claimed, reference being made to the accompanying drawings, forming a part hereof wherein numerals refer to like parts throughout.

FIGS. 9, 10, and 11, is a front, back, and side view of the automatic trigger and slide assembly.

Figure 12:
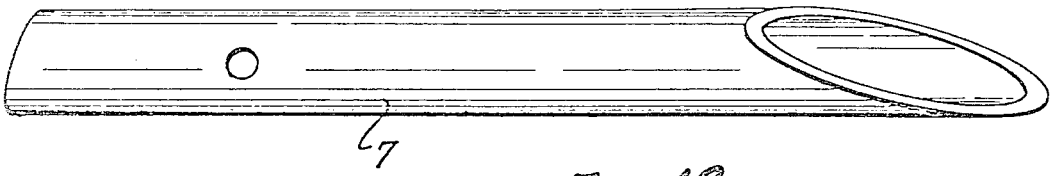

FIG. 12 is a side view of the inlet water control arm that fits the Ball float type toilets.

Figure 13:
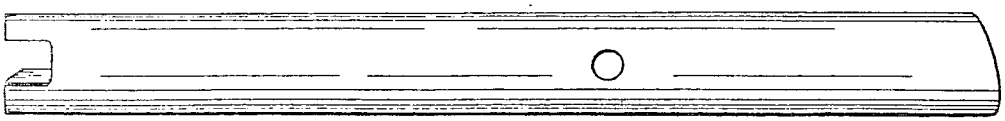

FIG. 13 is a side view of the inlet water control arm that fits the slide float assembly type toilets.

Figure 1:
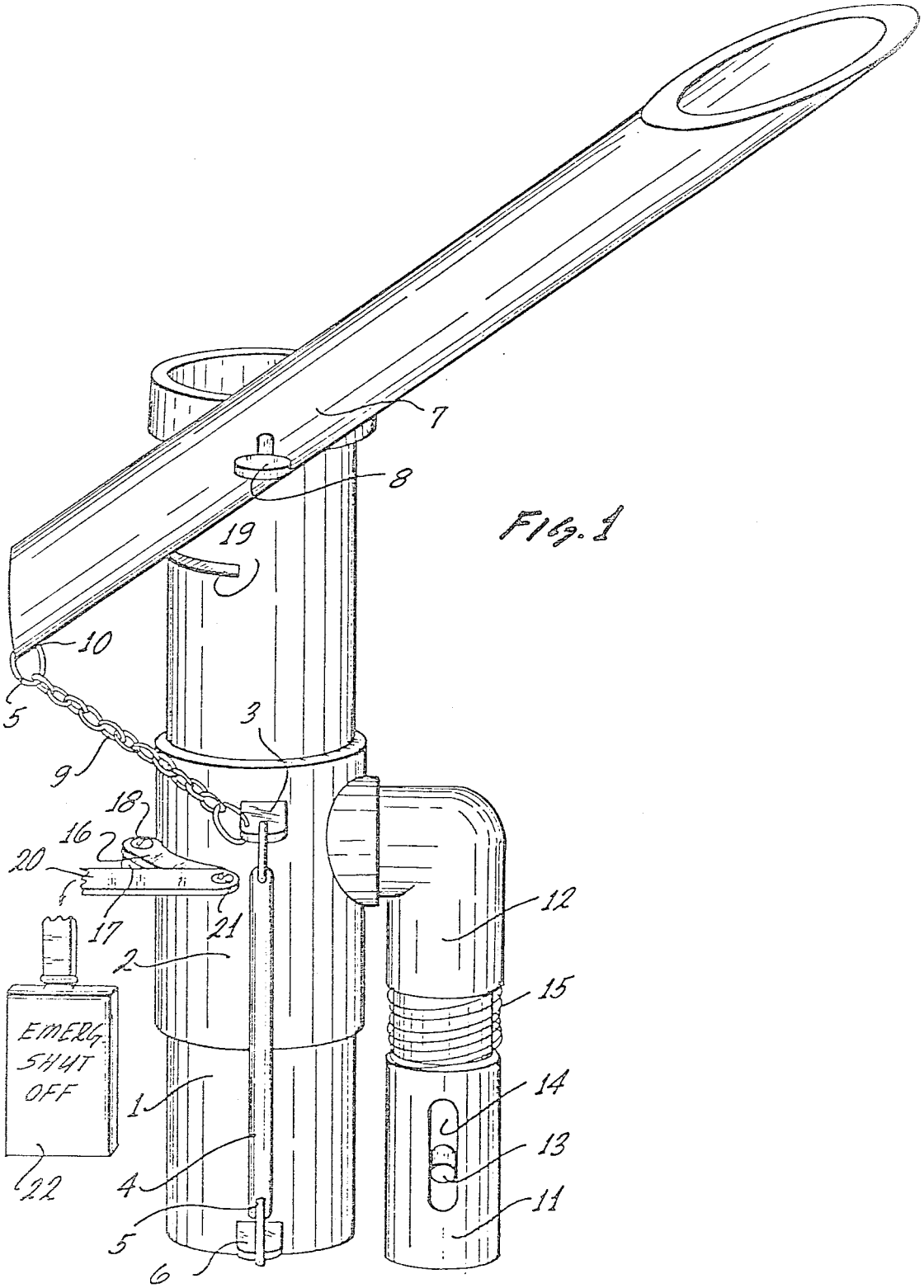
FIG. 1 is a front view of the toilet shut-off control of the present invention.
Figure 2:
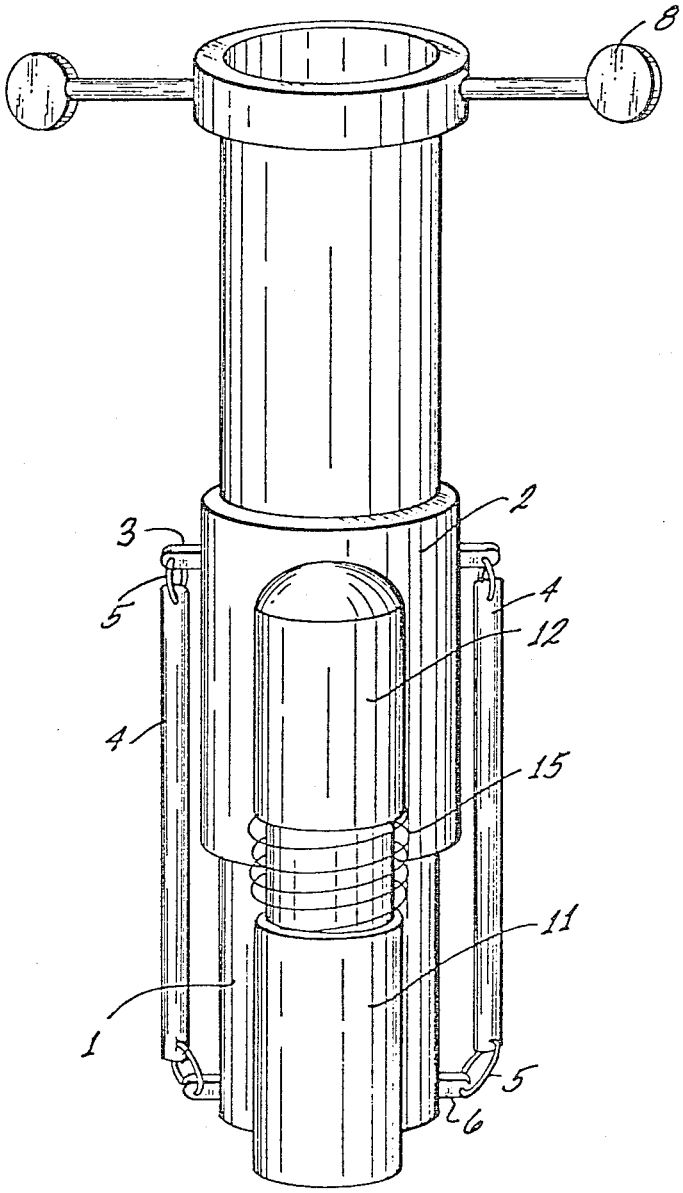
FIG. 2 is an end view without the inlet water control shut-off arm of the present invention.
Figure 3:
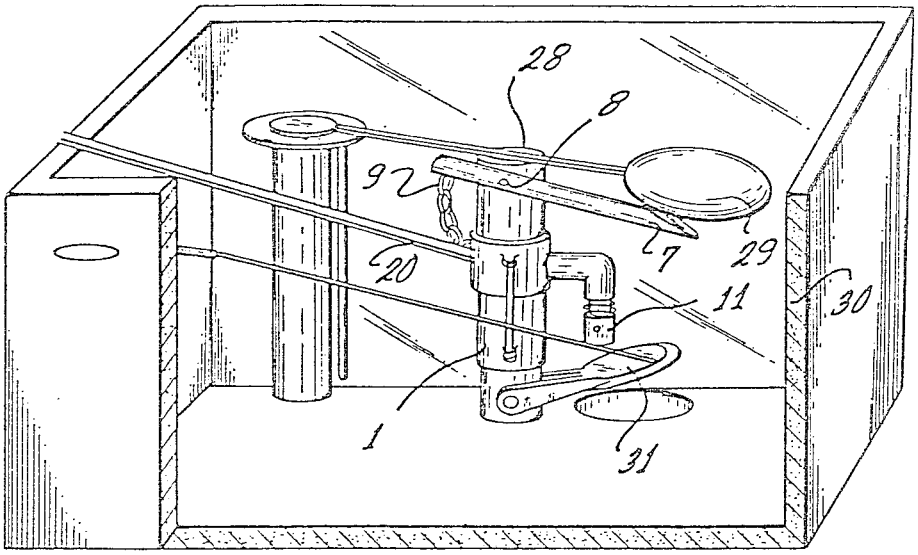
FIG. 3 is a transverse view through the toilet water holding tank of the ball float type in which the toilet is flushing and the present invention is in the primed and ready position.
Figure 7:
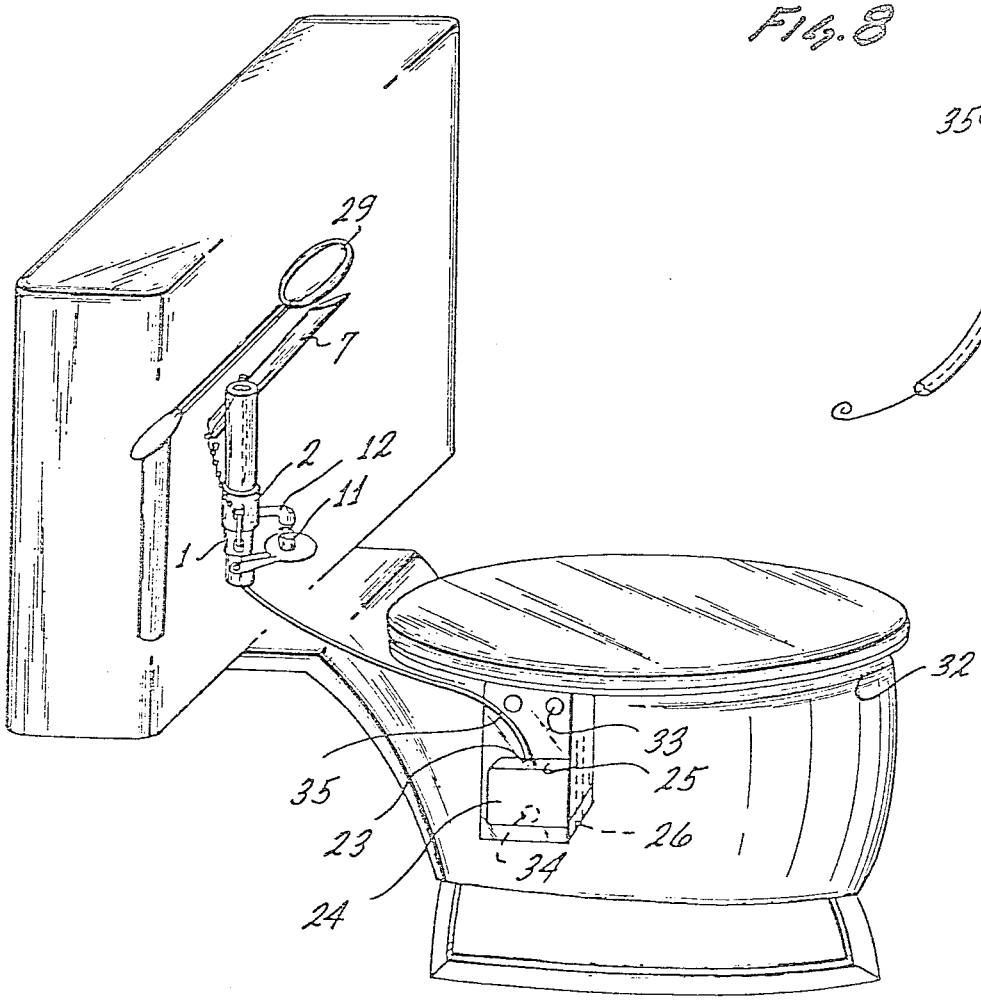
FIG. 7 is a side view through a complete toilet, including a water holding tank and a toilet bowl, wherein the present invention includes an automatic trigger mechanism built into the side wall of the toilet bowl.

Referring now to the drawings in greater detail, and more particularly FIG. 1, tubular body 1 is made out of durable plastic which installs over the standard standpipe assembly 28 in a toilet. The plastic slide assembly 2, is slightly larger in diameter, than the tubular body 1 which enables the slide assembly to raise or lower freely on the body 1. The slide assembly tab 3 is connected to the neopreme activator band 4 by the plastic connection ring 5. The plastic connection ring 5 will be used throughout as separate plastic rings. The opposite end of the neopreme band 4 connects to the body tab 6 by the plastic ring 5. The inlet water control arm 7, connects to the body 1, by a threaded thumb screw 8, enabling the inlet water control arm 7 to pivot freely. The inlet control adjustment chain 9 connects to the slide assembly tab 3 by the plastic ring 5. The opposite end of the control adjustment chain 9 connects to the chain adjustment support arm hole 10, by the plastic ring 5. The stainless steel cushion spring 15 slides on to the smaller end of the slide assembly arm 12 and, the outlet water control plunger 11 slips over the smaller end of the slide assembly 12. The cushion spring 15 and the outlet water control plunger 11 is held on to the slide assembly arm 12 by the guide pin 13. This enables the outlet water control plunger 11 to move in an upward and downward position in the plunger slot 14. The trigger arm 16 connects to the trigger 17 by a brass sheet metal screw 18, enabling the trigger arm to swing freely. The trigger control 20 connects to the trigger arm 16 by a brass sheet metal screw 21. This enables the trigger control 22 to be controlled outside the toilet tank walls manually. Referring to FIG. 7, a side view of the complete toilet with the automatic trigger mechanism 1 built-in. In reference to FIGS. 8, 9, 10 and 11, the automatic trigger 24, is made of durable plastic and is rectangular in size. The trigger mechanism 24, has an inlet water opening in the face 25 and is able to move in an upwards and downwards position between the rail and guides 27, 26. When the water level reaches the bottom of the toilet ring 32, the water enters through the toilet walls 33, (put in by a manufacturer) into the inlet opening of the trigger 25. When the trigger mechanism slides in a downward position between the rail and guides 27, 26, pulling on the activator cable 35, which is connected to the trigger arm 16 which triggers the emergency toilet water protection unit.

Figure 8:
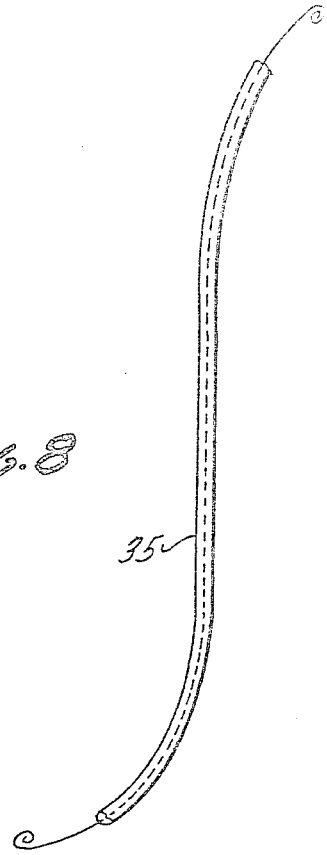
FIG. 8 is a view of the automatic trigger mechanism activator cable.

Referring to FIG. 8, a view of the activator cable which connects from the trigger mechanism tab 23 to the trigger control screw of 21, enabling the trigger mechanism 24 to control automatically. A small drain plug is set lower in the toilet walls 34, (by a manufacturer) to drain the trigger unit when triggered. It is thought that the operation of the manual and automatic emergency toilet shut-off control unit will be apparent from a consideration of the foregoing.

Figure 4:
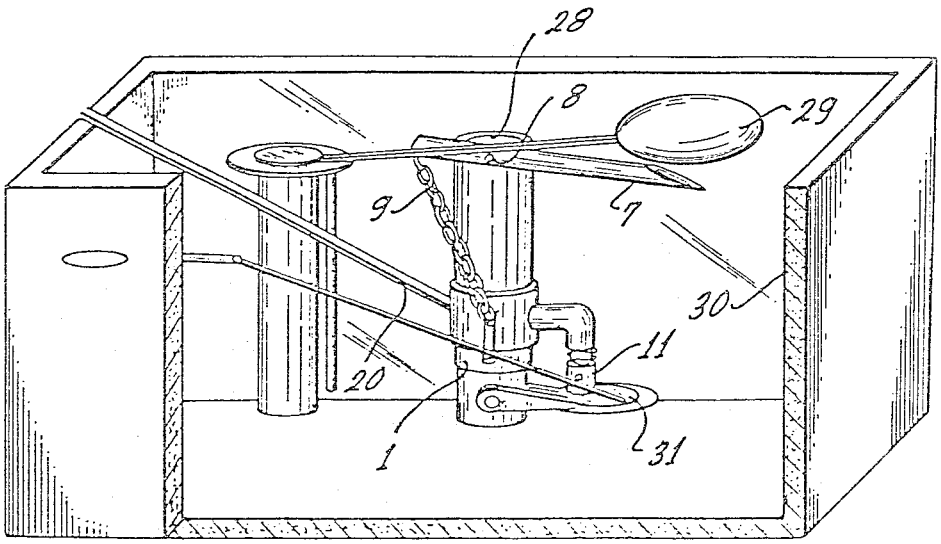
FIG. 4 is a transverse view through the toilet water holding tank of the ball float type wherein the present invention has been triggered and all inflowing and outflowing water has been stopped.
Figure 5:
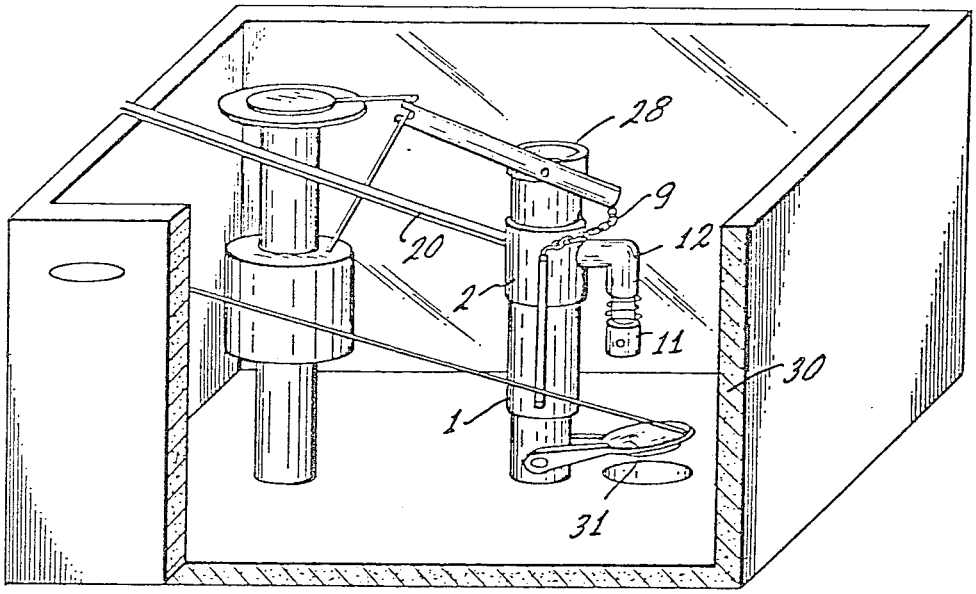
FIG. 5 is a transverse view through a toilet water holding tank of the slide float type wherein the toilet is flushing and the present invention is in the primed and ready position.
Figure 6:
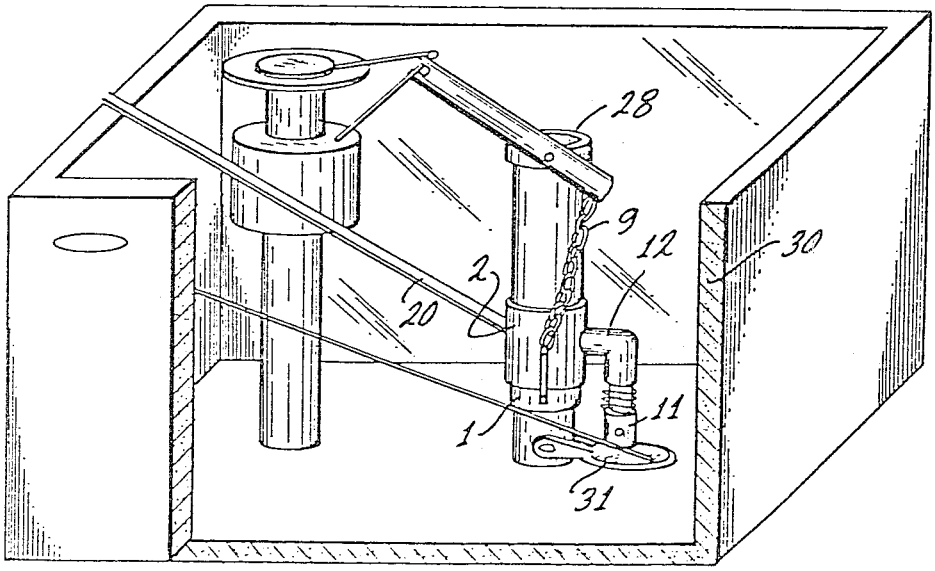
FIG. 6 is a transverse view through the toilet water holding tank of the slide float type wherein the present invention has been triggered and all inflowing and outflowing water has been stopped.

Referring to FIG. 4:

Briefly, to install: Remove toilet tank cover, slip the toilet shut-off body mechanism 1 over the toilet standpipe assembly 28. Line up the inlet water control arm 7 under the ball float 29. Tighten the thumb screw 8 which allows the inlet water control arm 7 to pivot on the body freely, and solidly mounts the body 1 to the standpipe assembly 28. Adjust the inlet control chain 9 so that the water control arm 7 applies firm pressure on the ball flaot 29. (note, that you do not let the outlet water control plunger 11 leave the ball cock 31). Drape the trigger control 20 over the left side of the tank 30. Unit is now installed in triggered position.

Referring to FIG. 1, to reset, raise slide assembly 2 until trigger arm 16 inserts in trigger control slot 19. Unit is now in set position. When trigger control 20 is pulled the unit will activate by lowering the outlet water control plunger 11 onto the ball cock 31 and raising the inlet water control arm 7 to shut off incoming water. All water incoming and outgoing is shut-off.

While various changes may be made in the detailed construction, it is understood that such changes will be within the spirit and scope of the present invention, as is defined by the appended claims.

I claim:

1. In combination with a flush toilet having a toilet bowl and a water supply tank, said tank including a ball float and an outlet water control plunger located adjacent to an upwardly extending pipe mounted inside said supply tank, a device for preventing toilet water overflow, comprising:

means for stopping the flow of water into and out of said supply tank, said means including a tubular sleeve member installed over said pipe, said tubular member including thereon an outer sleeve member, a control arm pivotedly attached to said tubular member and positioned below and in generally faced opposed relation to said ball float, a plunger member mounted onto and extending out from said outer sleeve member and positioned above and in generally faced opposed relation to said water control plunger, and, means for triggering said means for stopping the flow of water so that said control arm and said plunger member contact said ball float and said water control plunger, respectively, to stop the flow of water into and out of said supply tank.

2. The invention of claim 1 wherein said triggering means comprises a cable having a first end extending over a side wall of said supply tank and a second end attached to said trigger arm adjacent to said outer sleeve member, said trigger arm being in a cocked position so that upon pulling the first end of said cable, said trigger is engaged causing said plunger to move downwardly to contact said water control plunger and said control arm to move upwardly to contact said ball float.

3. The invention of claim 1 wherein the means for triggering comprises a container positioned adjacent to said toilet bowl, said container having a front wall, back wall, a first side wall, a second side wall, a top wall, and a bottom wall, said front wall and said top wall defining therebetween an inlet through which water flows, said top wall having attached thereto means for attaching a first end of a cable to said container, a second end of said cable being attached to a trigger arm adjacent to said outer sleeve member, said container positioned between rail and guide means along which said container may move in an upwards or downwards direction, whereby water entering said inlet causes said container to move downwardly so that said cable pulls on said trigger to release said plunger member downwardly and said control arm upwardly to shut off the flow of water into and out of said supply tank.

4. The invention of claim 3 wherein said means for triggering may be contained within a side wall of said toilet bowl.

5. In combination with a flush toilet having a toilet bowl and a water supply tank, said tank including a slide float and an outlet water control plunger located adjacent to an upwardly extending pipe mounted inside said supply tank, a device for preventing toilet water overflow, comprising:

means for stopping the flow of water into and out of said supply tank, said means including a tubular sleeve member installed over said pipe, said tubular member including thereon an outer sleeve member, a control arm pivotedly attached and positioned generally perpendicular to said tubular member, a plunger member mounted onto and extending out from said outer sleeve member and positioned above and in generally faced opposed relation to said water control plunger, and, means for triggering said means for stopping the flow of water so that said control arm moves upwardly causing said slide float to rise concurrently therewith and said plunger member to contact said water control plunger to stop, respectively, the flow of water into and out of said supply tank.

6. The invention of claim 5 wherein said triggering means comprises a cable having a first end extending over a side wall of said supply tank and a second end attached to said trigger arm adjacent to said outer sleeve member, said trigger arm being in a cocked position so that upon pulling the first end of said cable, said trigger is engaged causing said plunger to move downwardly to contact said water control plunger and said control arm to move upwardly causing said slide float to rise concurrently.

* * * * *